US007814889B2

(12) United States Patent
Mitsuhashi et al.

(10) Patent No.: US 7,814,889 B2
(45) Date of Patent: Oct. 19, 2010

(54) ELECTRIC FUEL PUMP

(75) Inventors: Takashi Mitsuhashi, Gunma (JP); Yoshihiro Kurosu, Gunma (JP); Takeharu Murakami, Gunma (JP); Haruhiko Ushirode, Gunma (JP)

(73) Assignee: Ogura Clutch Company, Ltd. (JP)

( * ) Notice: Subject to any disclaimer, the term of this patent is extended or adjusted under 35 U.S.C. 154(b) by 249 days.

(21) Appl. No.: 12/106,930

(22) Filed: Apr. 21, 2008

(65) Prior Publication Data

US 2008/0271714 A1 Nov. 6, 2008

(30) Foreign Application Priority Data

May 1, 2007 (JP) ..... 2007-120910
Mar. 14, 2008 (JP) ..... 2008-065590

(51) Int. Cl.
*F02M 37/04* (2006.01)
*F02M 37/08* (2006.01)

(52) U.S. Cl. ..... 123/497

(58) Field of Classification Search ..... 123/497, 123/495, 509; 417/423.3, 423.7, 423.14; 310/239, 85, 86, 54
See application file for complete search history.

(56) References Cited

U.S. PATENT DOCUMENTS 5,356,272 A * 10/1994 Nagata et al. ..... 417/366
2002/0180301 A1* 12/2002 Ebihara ..... 310/239

FOREIGN PATENT DOCUMENTS

JP 61-14496 1/1986
JP 2006022733 1/2006

* cited by examiner

*Primary Examiner*—Mahmoud Gimie
(74) *Attorney, Agent, or Firm*—Schwegman, Lundberg & Woessner, P.A.

(57) ABSTRACT

An electric fuel pump includes a pump unit, motor unit, fuel discharge unit, stator holder, magnet wire, connection terminal, first mold resin, driver board assembly, and second mold resin. The fuel discharge unit includes a discharge port member and discharges fuel supplied from the pump unit through the motor unit. The stator holder is provided to the motor unit and includes a partition which defines the motor unit and the fuel discharge unit. The partition includes a terminal insertion hole and a fuel passage. The connection terminal is connected to the magnet wire. The driver board assembly is stored in a space formed in the discharge port member and electrically connected to the connection terminal. The second mold resin molds the driver board assembly and a connecting portion where the driver board assembly is connected to the connection terminal.

6 Claims, 7 Drawing Sheets

ELECTRIC FUEL PUMP

RELATED APPLICATIONS

This application claims priority under 35 U.S.C. 119(e) from Japanese Patent Application No. 120910/2007 filed May 1, 2007, and from Japanese Patent Application No. 065590/2008 filed Mar. 14, 2008, which applications are incorporated herein in their entirety and made a part hereof.

BACKGROUND OF THE INVENTION

The present invention relates to an electric fuel pump used to supply fuel in the fuel tank of a vehicle, ship, or the like to an engine injector.

Recently, in consideration of environmental issues, various types of electric fuel pumps to supply alcohol or alcohol blended fuel as fuel have been proposed as described in Japanese Patent Laid-Open Nos. 2006-22733 (prior art reference 1) or 61-14496 (prior art reference 2).

The electric fuel pump described in prior art reference 1 comprises an impeller which is rotated by a brushless motor (to be simply referred to as a motor hereinafter) when supplying fuel. The impeller is rotated by a motor, and draws alcohol blended fuel from a pump suction channel and guides it to a pump chamber. The fuel guided to the pump chamber is pressurized to open a check valve with its fluid pressure, and is discharged from a discharge channel and supplied to an injector. In the electric fuel pump, the inner surface of a housing and a wall surface that forms a fuel flow passage are rustproofed, and a resin mold forms a resin film on the surface of a magnet wire or on that surface of an internal lead wire where the flow passage is exposed. This prevents rusting or corrosion.

In the fuel transfer apparatus described in prior art reference 2, a transfer member (impeller) is rotated by a brushless motor to draw the fuel in a fuel tank into the pump chamber and to pressurize the fuel. The fuel is guided from the pump chamber to a motor chamber and discharged from a discharge port through the opening of a spacer so as to be supplied to an injector. Constituent members necessary to control the motor are arranged in the fuel flow channel and are accordingly cooled by the fuel.

In recent years, in consideration of the environmental issues, as the engine driving fuel, alcohol has become being used alone or in the form of an alcohol blended fuel in place of a fossil fuel. In some countries, ethanol is produced from sugar cane and used as the fuel. In an electric fuel pump that supplies an alcohol fuel as a renewable resource to an engine, to take a countermeasure to prevent rusting and corrosion is a major issue.

In the electric fuel pump described in prior art reference 1, the resin film is formed on the internal conductor wire such as the magnet wire or lead wire, thus preventing rusting and corrosion. The conductor wire such as the magnet wire or lead wire is electrically connected in the fuel passage in the motor chamber. Accordingly, if the formed film is insufficient, as the pump is used over a long period of time, corrosion is likely to occur.

The lead wire itself is held by the housing cover with the elastic restoration force of a holding member such as a rubber bush fitted in the lead wire outlet in the housing cover or with the fixing force of a mold resin filled in the lead wire outlet. Due to a long-period use, however, if the elastic restoration force of the holding member or the fixing force of the resin mold decreases and the internal conduction wire becomes loose, since the internal conduction wire is located near the upper end of a rotor, the internal conduction wire may come into contact with the rotating rotor. This separates the film to lead to corrosion or disconnection.

In the fuel transfer apparatus described in prior art reference 2, the winding end of the magnet wire is electrically connected to the contact pin of a control member projecting into the fuel passage. Therefore, some countermeasure is necessary to prevent rusting and corrosion in the same manner as in the fuel pump described in prior art reference 1.

The fuel transfer apparatus constitutes an in-line fuel pump which is disposed outside a fuel tank and in which a suction pipe is connected to a suction port and a discharge pipe is connected to a discharge port. Such a fuel transfer apparatus is sometimes used as an in-tank fuel pump which is used as it is submerged in the fuel in the fuel tank. Hence, a countermeasure is necessary that prevents the fuel from penetrating into the electrical connecting portion between the control member and an external power supply.

SUMMARY OF THE INVENTION

It is an object of the present invention to provide an electric fuel pump in which rusting or corrosion of an electric system between a magnet wire and power supply is prevented.

It is another object of the present invention to provide an electric fuel pump that can be used as it is submerged in fuel in a fuel tank.

In order to achieve the above objects, according to the present invention, there is provided an electric fuel pump comprising a pump unit, a motor unit which drives the pump unit, a fuel discharge unit which includes a discharge port member and discharges fuel supplied from the pump unit through the motor unit, a stator holder provided to the motor unit and including a stator support which supports a stator of a motor and a partition which defines the motor unit and the fuel discharge unit, the partition including a terminal insertion hole and a fuel passage, a magnet wire wound around a core of the stator, a connection terminal connected to the magnet wire, a first mold resin which molds the core and a connecting portion where the magnet wire is connected to the connection terminal, a driver board assembly which is stored in a space formed in the discharge port member and electrically connected to the connection terminal, and a second mold resin which molds the driver board assembly and a connecting portion where the driver board assembly is connected to the connection terminal.

DESCRIPTION OF THE PREFERRED EMBODIMENTS

Figure 1:
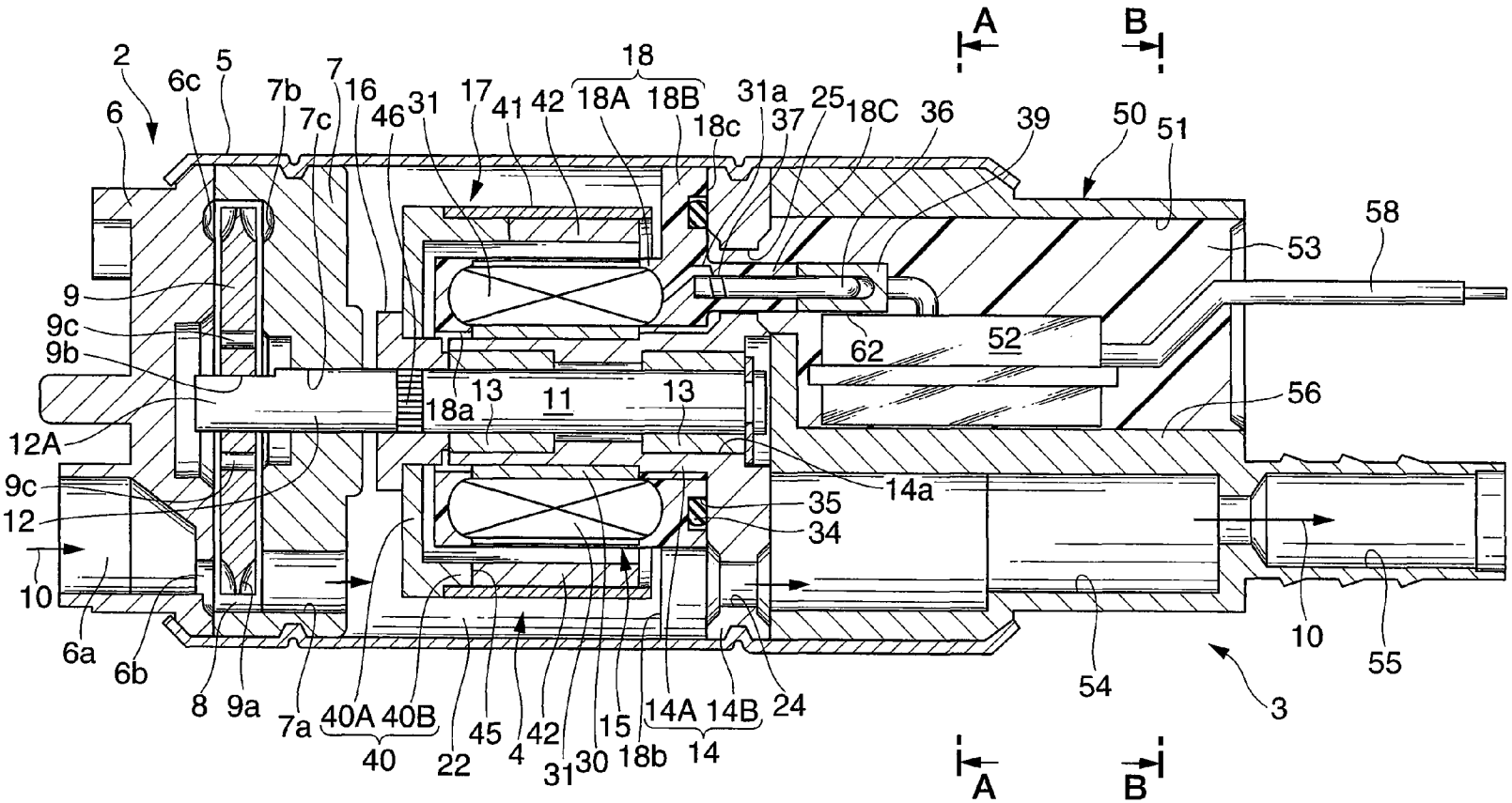
FIG. 1 is a sectional view of an electric fuel pump according to an embodiment of the present invention.

An electric fuel pump according to the first embodiment of the present invention will be described with reference to FIGS. 1 to 10. As shown in FIG. 1, an electric fuel pump 1 constitutes a wesco type fuel pump which is submerged in alcohol or alcohol blended fuel filled in the fuel tank of a vehicle, ship, or the like to supply the fuel in the fuel tank to an engine injector when the pump is driven by a motor. The electric fuel pump 1 comprises a pump unit 2 located on the left side, a discharge unit 3 located on the right side, and a motor unit 4 located at the center in FIG. 1.

The pump unit 2 includes a pump cover 6 and pump housing 7 built into an opening at one end of a cylindrical casing 5 with two open ends, and an impeller 9 rotatably disposed in a pump chamber 8 formed between the contact surfaces of the pump cover 6 and pump housing 7.

The pump cover 6 is formed of a synthetic resin into a disc, projects outside the casing 5 with its one end, and has a suction port 6*a* through which fuel 10 in a fuel tank (not shown) is drawn, a communicating passage 6*b* which allows the suction port 6*a* to communicate with the pump chamber 8, and an annular pump passage 6*c* which is formed in an inner surface opposing vanes 9*a* provided on the periphery of the impeller 9 and communicates with the pump chamber 8.

The pump housing 7 is similarly formed of a synthetic resin integrally, is arranged inside the pump cover 6 in tight contact with it, and has a distribution passage 7*a* which allows the pump chamber 8 to communicate with a motor chamber 22 of the motor unit 4, and a pump passage 7*b* which is formed in an inner surface opposing the vanes 9*a* of the impeller 9 and communicates with the pump chamber 8. The distribution passage 7*a* opposes the communicating passage 6*b* through the pump chamber 8. The pump passage 6*c* and pump passage 7*b* oppose each other.

The impeller 9 is formed of a synthetic resin into a disc, has the plurality of vanes 9*a* formed at its periphery, a central hole 9*b*, and a plurality of communication holes 9*c* concentrically formed around the central hole 9*b*, and is fixed to one end 12A of a rotating shaft 12 of a motor 11.

The motor 11 is disposed in the motor unit 4. The motor 11 includes the rotating shaft 12, a stator holder 14 which rotatably, axially supports the rotating shaft 12 through a pair of left and right bearings 13, a stator 15 arranged on the outer circumferential surface of a stator support 14A of the stator holder 14, and a rotor 17 disposed on the rotating shaft 12 through a hub 16, thus constituting a DC brushless motor. A space surrounded by the casing 5 and pump housing 7 which store the motor 11, the stator holder 14, and a first mold resin 18 (to be described later) forms a motor chamber 22 which stores the motor 11.

The stator holder 14 is formed of a nonmagnetic metal material and comprises the cylindrical stator support 14A having a central hole 14*a* formed of a through hole, and a disc-like partition 14B integrally projecting from that end of the outer circumferential surface of the stator support 14A which is close to the fuel discharge unit 3.

The central hole 14*a* of the stator support 14A rotatably, axially supports the rotating shaft 12 through the pair of bearings 13. The partition 14B has a fuel passage 24 formed of a through hole, and a terminal insertion hole 25. The outer circumferential surface of the stator support 14A is fixed to the inner circumferential surface of the stator support 14A, thus defining the fuel discharge unit 3 and motor unit 4.

Figure 2:
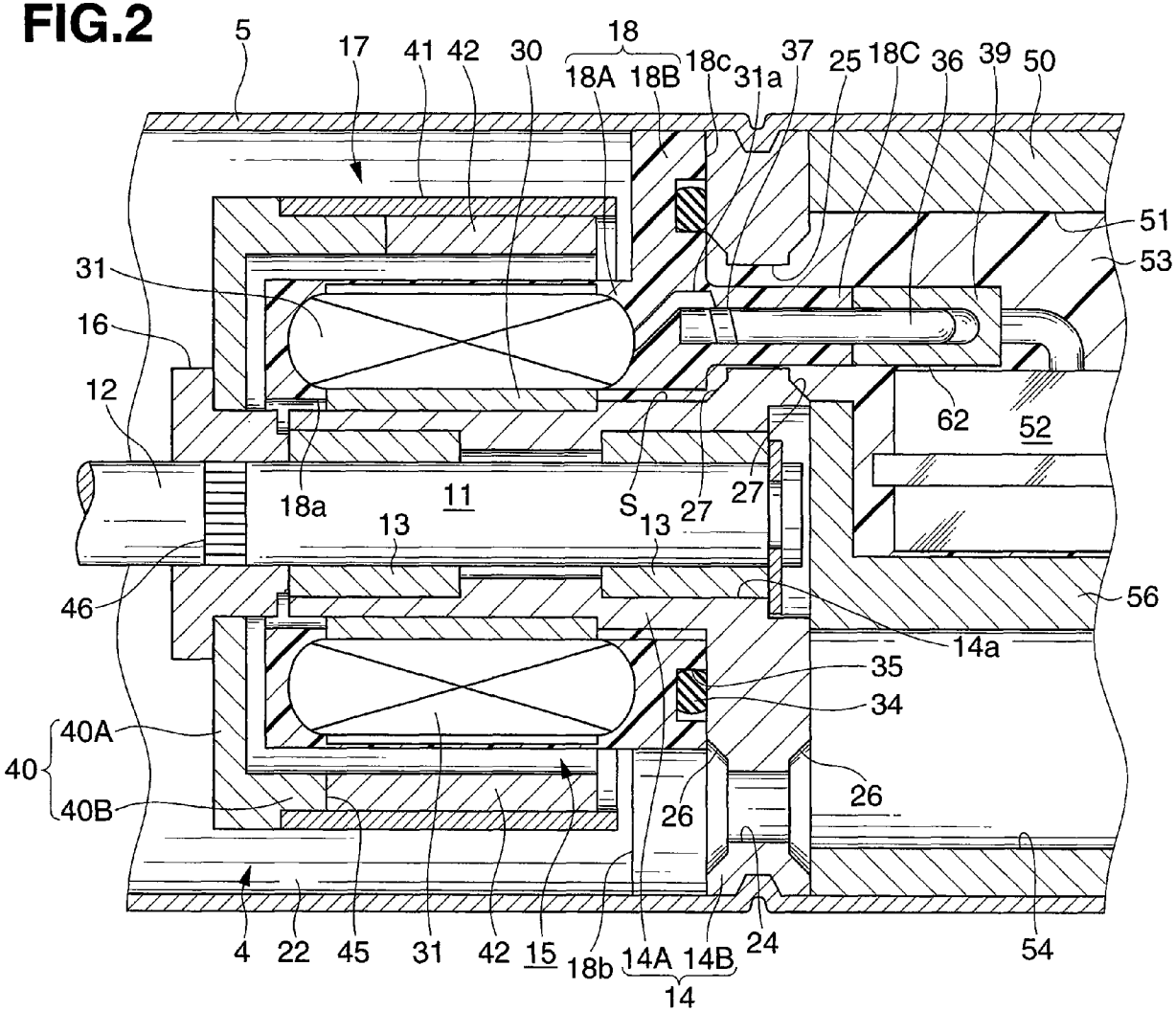
FIG. 2 is an enlarged view of a connector connecting portion and its vicinity shown in FIG. 1.
Figure 7:
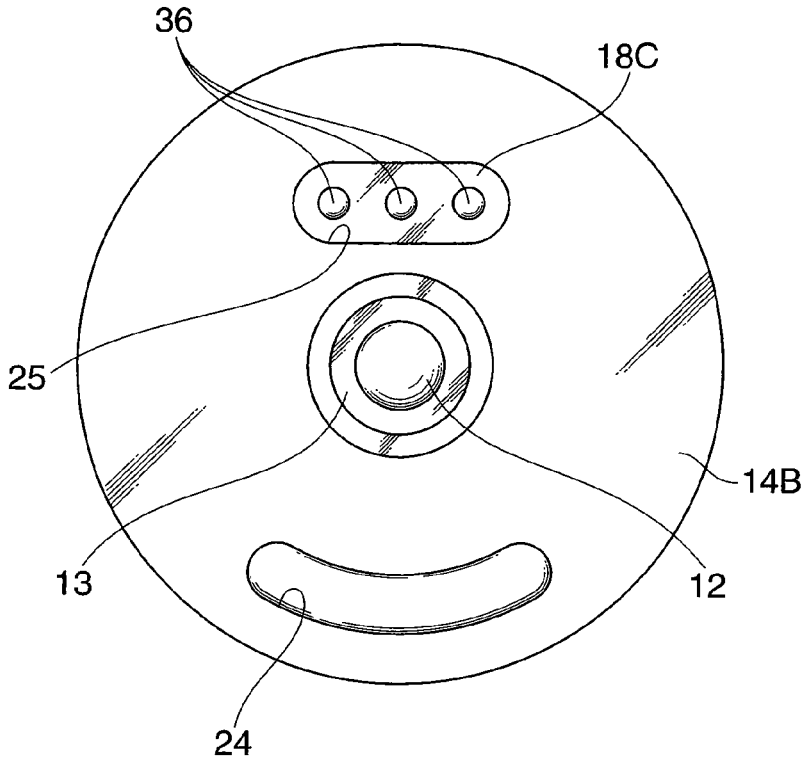
FIG. 7 is a right side view of a stator shown in FIGS. 1 and 2.

As shown in FIG. 7, the fuel passage 24 comprises an elongated hole which is long in the circumferential direction of the partition 14B, and allows the motor chamber 22 and fuel discharge unit 3 to communicate with each other. The terminal insertion hole 25 comprises a linear elongated hole, and opposes the fuel passage 24 such that it is shifted from the fuel passage 24 by 180° in the circumferential direction of the partition 14B. The open edges of the fuel passage 24 and terminal insertion hole 25 are chamfered to form conical tapered surfaces 26 and 27, respectively, as shown in FIG. 2. Although the fuel passage 24 comprises an arcuate elongated hole in this embodiment, it is not limited to this, but may comprise a notched groove formed in the outer portion of the partition 14B.

The end 12A of the rotating shaft 12 rotatably extends through a central hole 7*c* of the pump housing 7 to be inserted in the pump chamber 8, and is attached with the impeller 9.

The stator 15 includes a core 30 mounted on the outer circumferential surface of the stator support 14A of the stator holder 14, a three-phase magnet wire 31 having a plurality of (e.g., 12) magnet wires wound around the core 30, and the first mold resin 18 which molds the core 30 and magnet wire 31 to integrally connect them. The stator 15 is fixed as it is molded with the first mold resin 18 and fitted on the outer portion of the stator support 14A of the stator holder 14.

Figure 10:
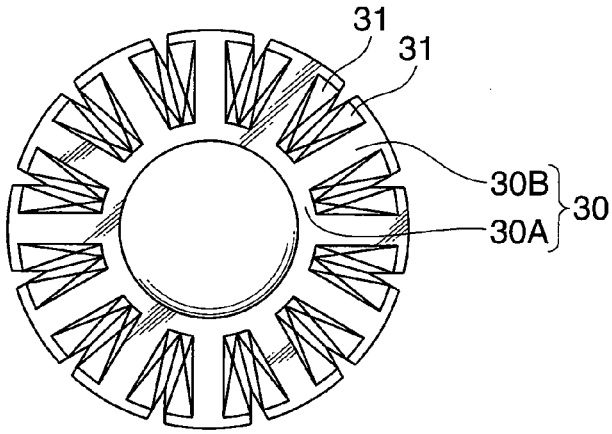
FIG. 10 is a sectional view of the stator shown in FIGS. 1 and 2.

As shown in FIG. 10, the core 30 comprises a cylindrical portion 30A and 12 plate portions 30B radially extending from the outer portion of the cylindrical portion 30A. The magnet wire 31 is wound around each plate portion 30B. The core 30 and first mold resin 18 completely cover the magnet wire 31 to prevent it from coming into contact with the fuel 10. Three coil ends 31*a* of the magnet wire 31 extend through the first mold resin 18 and are respectively connected to three connection terminals 36. The first mold resin 18 also molds connecting portions 37 where the coil ends 31*a* are connected to the connection terminals 36, to prevent the connecting portions 37 from coming into contact with the fuel 10.

Figure 9:
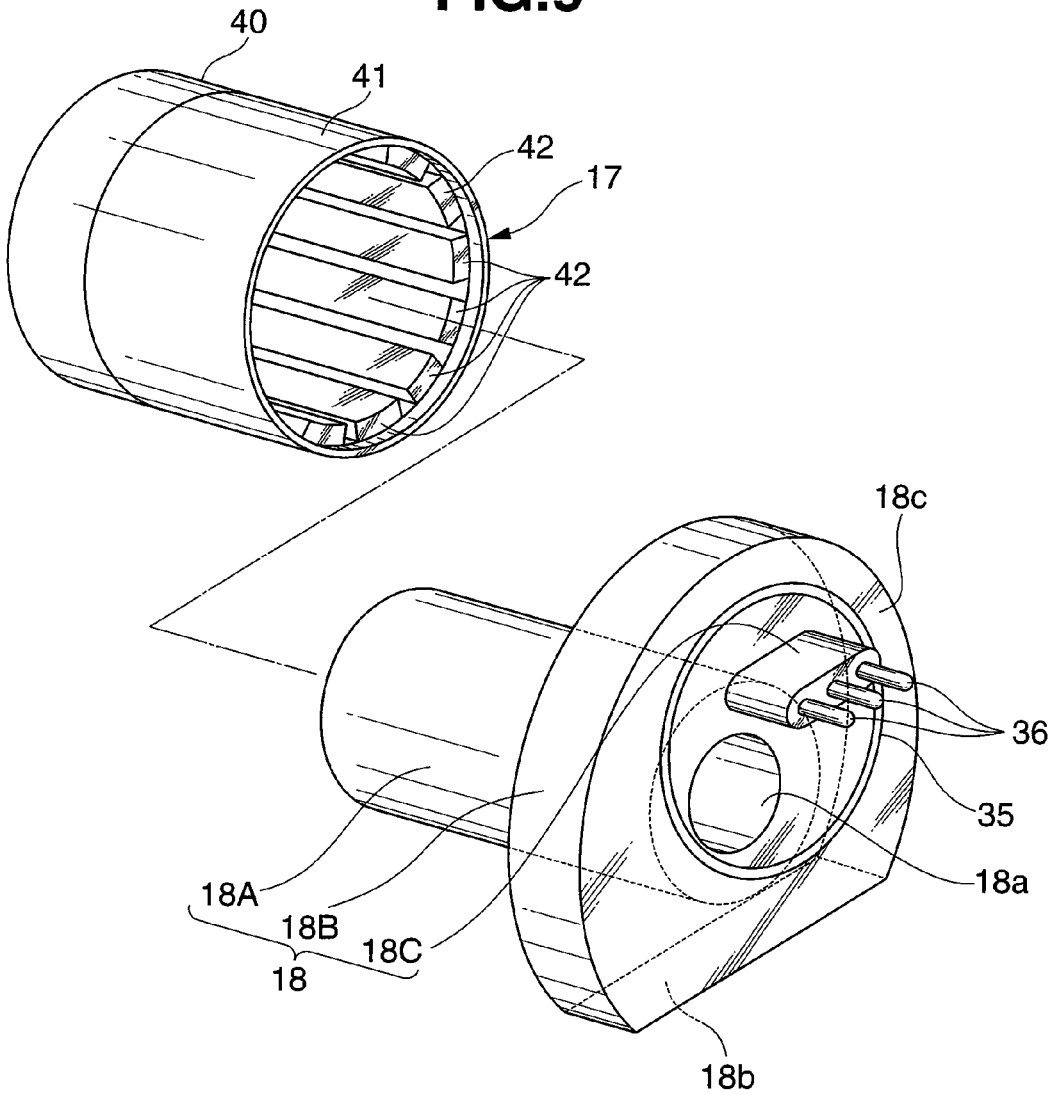
FIG. 9 is a perspective view of the rotor and a first mold resin shown in FIGS. 1 and 2.

The first mold resin 18 is, e.g., an epoxy resin, and comprises a cylindrical portion 18A which molds the core 30 and magnet wire 31 to integrally connect them, and a flange 18B integrally projecting from the outer portion of that end of the cylindrical portion 18A which is close to the fuel discharge unit 3. The inner diameter of a central hole 18*a* of the cylindrical portion 18A is larger than the outer diameter of the stator support 14A. As shown in FIG. 9, the flange 18B is arcuate on its upper side and forms a notched passage 18*b* serving as a fuel passage on its lower side, thus forming a D shape when seen from the side. The flange 18B is arranged such that its side surface 18*c* close to the fuel discharge unit 3 is in tight contact with the partition 14B of the stator holder 14 through a seal member 34.

The notched passage 18*b* is formed to allow the motor chamber 22 and fuel passage 24 to communicate with each other, but is not limited to this, but may be a through hole communicating with the fuel passage 24. In this case, the flange 18B may be formed of a disc. The seal member 34 is fitted in an annular groove 35 formed in that side surface 18*c* of the flange 18B which is close to the fuel discharge unit 3. The annular groove 35 is eccentric with respect to the axis of the first mold resin 18.

Furthermore, inside the annular groove 35, a mold portion 18C which molds the connecting portions 37 where the coil ends 31*a* of the magnet wire 31 are connected to the connecting portions 37 of the connection terminals 36 integrally projects on the side surface 18*c* of the flange 18B. The mold portion 18C forms the terminal insertion hole 25 of the partition 14B of the stator holder 14 and a projecting body similar to but smaller than it, and is inserted in the discharge unit 3 through the terminal insertion hole 25. The distal ends of the respective connection terminals 36 project from the mold portion 18C and are connected to a driver board assembly 52 (to be described later) through a connector 39 electrically and mechanically.

The rotor 17 includes a support member 40 fixed to the outer portion of the rotating shaft 12 through the hub 16, a cylindrical yoke 41 attached to the support member 40 and surrounding the stator 15, and a plurality of (e.g., 14) permanent magnets 42 fixed to the support member 40 at predetermined intervals in the circumferential direction. The hub 16 is pressed into and fixed to a knurled portion 46 formed on the outer surface of the rotating shaft 12.

Figure 8:
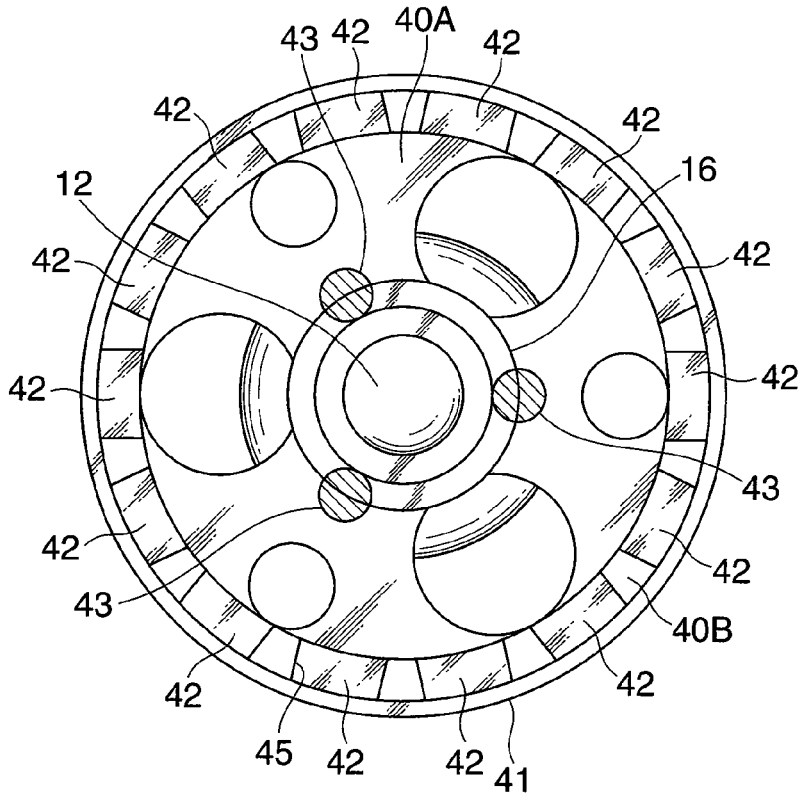
FIG. 8 is a right side view of a rotor shown in FIGS. 1 and 2.

The support member 40 is formed of a nonmagnetic metal material such as aluminum and comprises a disc portion 40A fixed to the outer portion of the hub 16 by caulking, and a cylindrical portion 40B projecting from the peripheral edge of the disc portion 40A toward the fuel discharge unit 3. The cylindrical portion 40B has a plurality of slits 45 elongated in the axial direction equidistantly in the circumferential direction. The permanent magnets 42 are fixed in the respective slits 45. One end of the yoke 41 is fixed to the outer portion of the cylindrical portion 40B and covers the permanent magnets 42 and slits 45. Hatched portions 43 in FIG. 8 represent fixing portions where the disc portion 40A is fixed to the hub 16 by caulking.

The fuel discharge unit 3 includes a cylindrical discharge port member 50 provided to that open end of the casing 5 which is opposite to the pump unit 2, the driver board assembly 52 built into an inner space 51 of the discharge port member 50, and a second mold resin 53 which molds the driver board assembly 52. The discharge port member 50 forms the inner space 51 for storing the driver board assembly 52, a fuel passage 54 communicating with the motor chamber 22 through the fuel passage 24, and a discharge port 55 communicating with the fuel passage 54. A partition 56 is provided among the inner space 51, fuel passage 54, and discharge port 55 to partition them.

Figure 3:
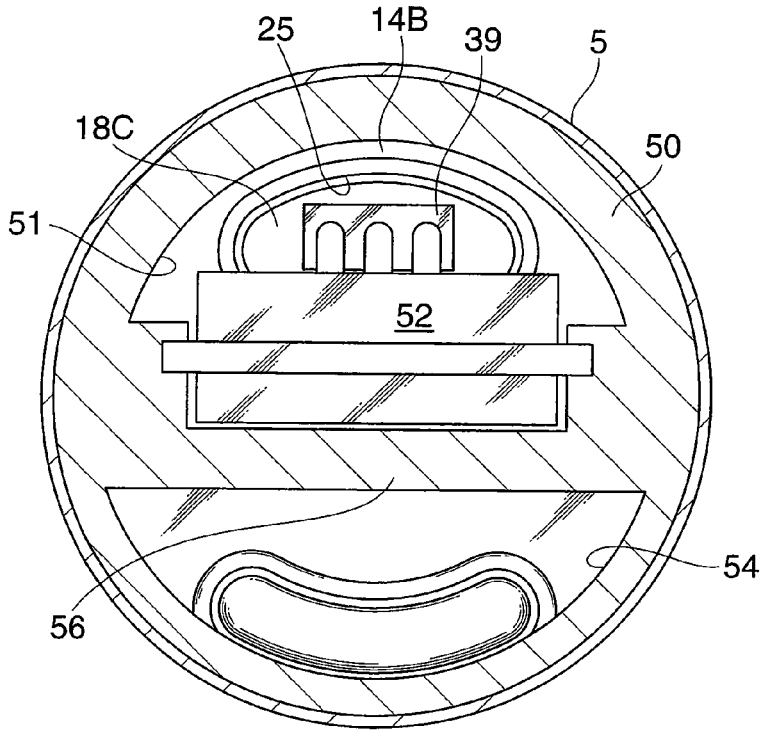
FIG. 3 is a sectional view taken along the line A-A of FIG. 1 before resin molding.
Figure 4:
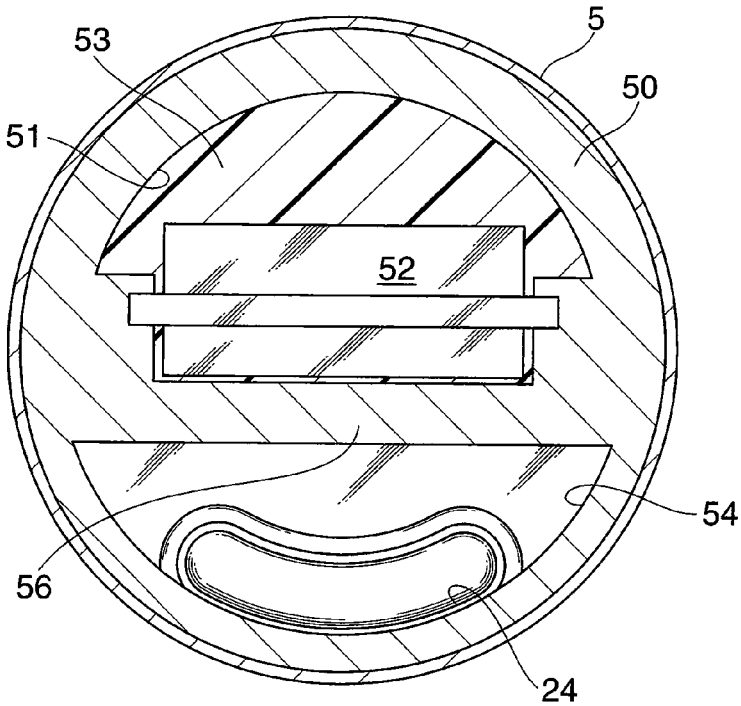
FIG. 4 is a sectional view taken along the line A-A of FIG. 1 after resin molding.
Figure 5:
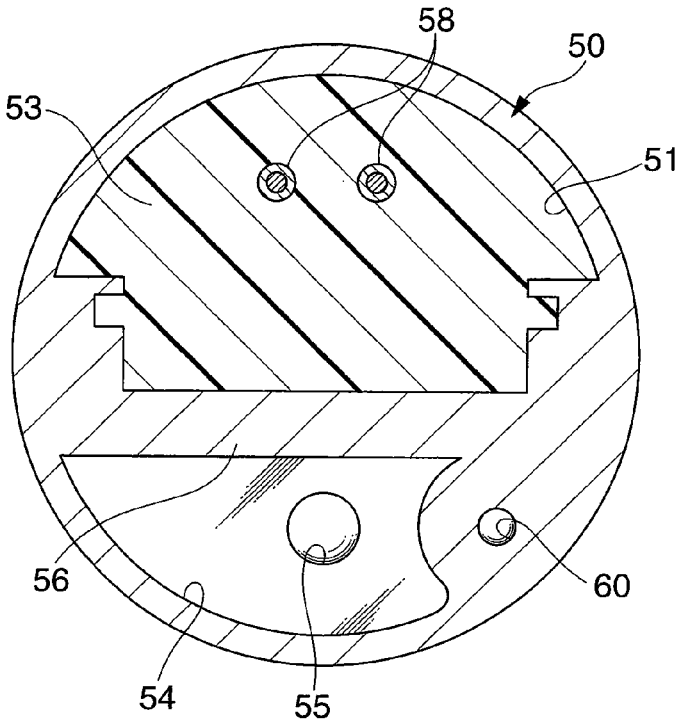
FIG. 5 is a sectional view taken along the line B-B of FIG. 1 after resin molding.
Figure 6:
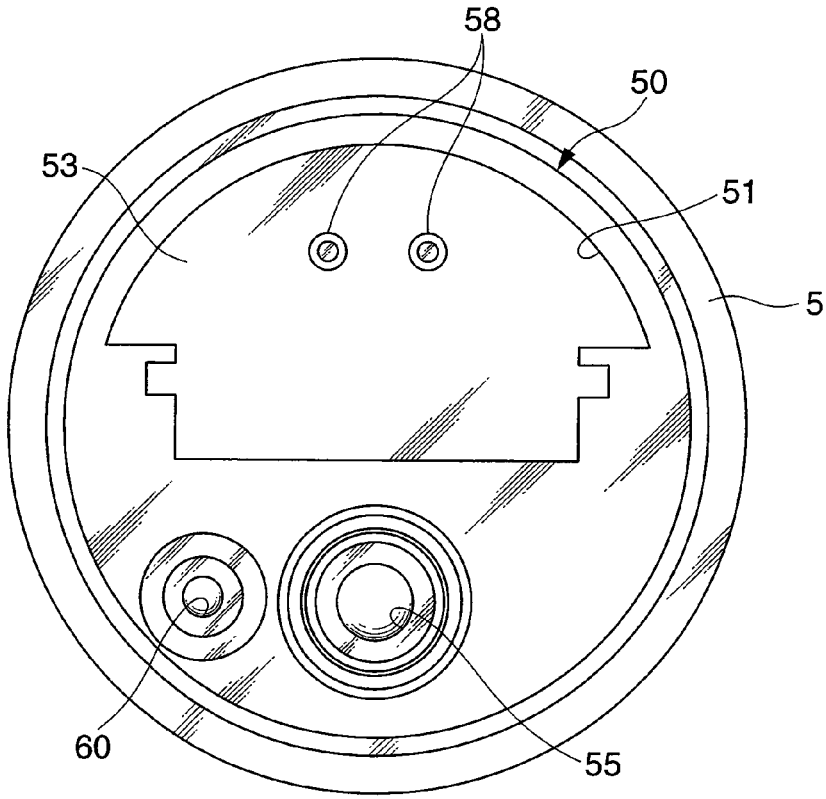
FIG. 6 is a right side view of FIG. 1.

As shown in FIGS. 3 to 5, the partition 56 forms a plate parallel to the central line of the rotating shaft 12. Accordingly, the inner space 51 and fuel passage 54 have semicircular sectional shapes. Note that a check valve (not shown) is built into the discharge port 55 to prevent the fuel 10 from running back to the motor chamber 22. In FIGS. 5 and 6, reference numeral 60 denotes a vapor bleeder passage into which a vapor bleeder device (not shown) is built. Regarding the vapor bleeder device, an arrangement described in prior art reference 2 is incorporated in this specification.

The driver board assembly 52 includes a circuit board to drive the motor 11, various types of electronic components such as a capacitor and resistor mounted on the circuit board, and the connector 39 which connects the connection terminals 36 to the circuit board. Lead wires 58 of the driver board assembly 52 are guided outside the discharge port member 50 through the second mold resin 53 and connected to a power supply (not shown).

The second mold resin 53 is an epoxy resin or the like, and fills the inner space 51 in the discharge port member 50 to mold the driver board assembly 52, thereby isolating it from the fuel 10. The second mold resin 53 molds a connecting portion 62 where the connection terminals 36 are connected to the connector 39. Part of the second mold resin 53 runs through the gap between the terminal insertion hole 25 of the stator holder 14 and the mold portion 18C of the first mold resin 18 and fills an annular gap S (FIG. 2) formed between the outer circumferential surface of the stator support 14A and the inner circumferential surface of the first mold resin 18. This prevents the fuel 10 in the motor chamber 22 from entering the inner space 51 of the fuel discharge unit 3 through the gap S and terminal insertion hole 25 to come into contact with the connecting portion 62 where the connection terminals 36 are connected to the connector 39, and the driver board assembly 52.

The electric fuel pump 1 having the above arrangement is built into the pump case of an in-tank fuel pump device. When transferring the fuel 10, power is supplied to the magnet wire 31 to drive the motor 11, so that the impeller 9 rotates together with the rotating shaft 12. Then, the fuel 10 in the fuel tank is drawn into the pump chamber 8 through a filter. The fuel 10 drawn into the pump chamber 8 is guided to the fuel passage 54 via the distribution passage 7*a*, motor chamber 22, and fuel passage 24. When the fuel 10 is pressurized to a pressure equal to or more than a predetermined pressure, it opens the check valve in the discharge port 55 with its pressure and is discharged outside through the discharge port 55, so that the fuel 10 is supplied to the engine injector.

In the electric fuel pump 1 having the above arrangement, rusting and corrosion of an electric system between the magnet wire 31 and driver board assembly 52 by the fuel 10 can be prevented reliably, thus improving the durability of the fuel pump 1. More specifically, according to the present invention, the driver board assembly 52 is stored in the inner space 51 of the discharge port member 50, and the connection terminals 36 are connected to the driver board assembly 52 through the connector 39. After that, the second mold resin 53 is charged into the inner space 51 to mold the connecting portion 62 where the connection terminals 36 are connected to the connector 39, and the driver board assembly 52. Therefore, the fuel 10 will not come into contact with the connection terminals 36, connector 39, or driver board assembly 52. This can prevent rusting, corrosion, disconnection, or the like of the electric system reliably.

When the second mold resin 53 is charged in the inner space 51 of the discharge port member 50, part of it runs through the terminal insertion hole 25 of the stator holder 14 to fill the annular gap S formed between the stator support 14A and first mold resin 18 and solidifies there. This can fix the stator 15 to the stator support 14A of the stator holder 14 firmly, and reliably prevent the fuel 10 in the motor chamber 22 from entering the discharge unit 3 through the terminal insertion hole 25.

Figure 11:
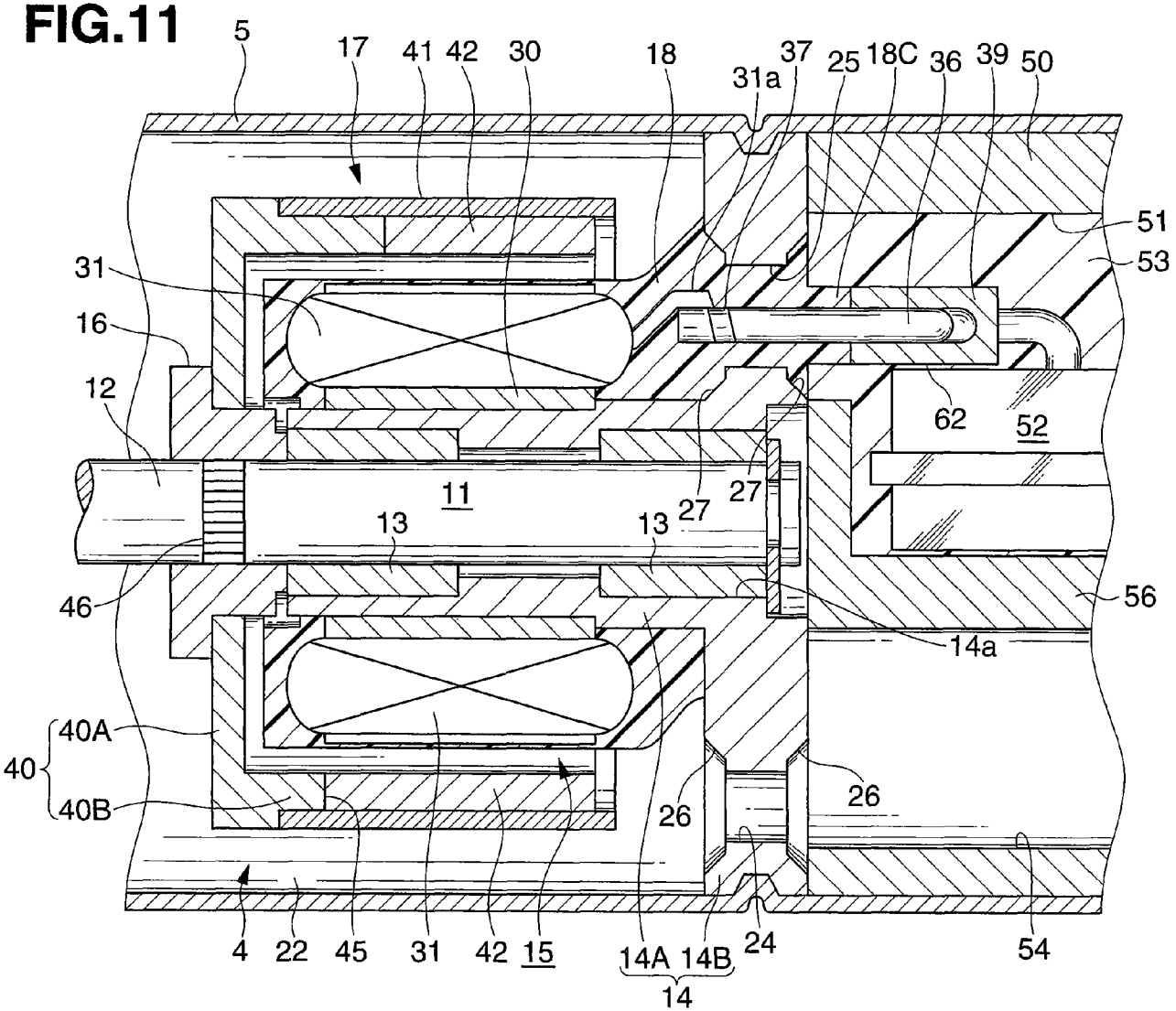
FIG. 11 is a sectional view showing the second embodiment of the present invention.

The second embodiment of the present invention will be described with reference to FIG. 11. The second embodiment is different from the first embodiment in the following respects. Namely, a stator 15 to which coil ends 31*a* of a magnet wire 31 and connection terminals 36 are connected is fitted and fixed in a stator support 14A of a stator holder 14. After that, a core 30, connecting portions 37 where the coil ends 31*a* are connected to the connection terminals 36, and the stator support 14A are molded with a first mold resin 18. Also, the first mold resin 18 molds the outer circumferential surface of the stator support 14A of the stator holder 14 and that side surface of a partition 14B which is close to a motor unit 4, thereby sealing a terminal insertion hole 25. Therefore, no seal member (the seal member 34 in FIG. 1) need be interposed between the partition 14B and first mold resin 18. The second embodiment is different from the first embodiment in this respect as well.

According to this embodiment, after the stator 15 is fitted on the stator holder 14, the stator holder 14 and stator 15 are molded with the first mold resin 18, so that the terminal insertion hole 25 is sealed by the mold resin itself. Except for this, the arrangement of the second embodiment is almost the same as that of the first embodiment. Hence, the same constituent members and portions are denoted by the same reference numerals, and a detailed description thereof will be omitted where appropriate.

According to this electric fuel pump, as the stator holder 14 and stator 15 are integrally molded with the first mold resin 18, they can be connected firmly.

As has been described above, according to the present invention, the first mold resin molds the stator and the connecting portions where the coil terminals of the magnet wire are connected to the connection terminals, and the second mold resin molds the driver board assembly and the connecting portions where the driver board assembly is connected to the connection terminals. This can reliably prevent the magnet wire, connection terminals, and driver board assembly from rusting, being corroded, or being disconnected, thus improving the reliability and durability of the pump.

After the stator is attached to the stator support of the stator holder, the first mold resin molds the stator. Therefore, the stator and stator support can be connected integrally. The second mold resin which is charged in the annular gap integrally connects the stator support of the stator holder to the first mold resin. Therefore, the stator can be fixed to the stator support firmly.

The flange provided to the first mold resin is brought into tight contact with the partition of the stator holder through the seal member. This can prevent the fuel from entering the fuel discharge unit through the terminal insertion hold in the partition.

What is claimed is:

1. An electric fuel pump comprising:

a pump unit;

a motor unit which drives said pump unit;

a fuel discharge unit which includes a discharge port member and discharges fuel supplied from said pump unit through said motor unit;

a stator holder provided to said motor unit and including a stator support which supports a stator of a motor and a first partition which partitions said motor unit and said fuel discharge unit, said first partition including a terminal insertion hole and a fuel passage;

a magnet wire wound around a core of said stator;

a connection terminal connected to said magnet wire;

a first mold resin which molds said core and a connecting portion where said magnet wire is connected to said connection terminal;

a second partition which partitions an interior of said discharge port member into an inner space communicated with said terminal insertion hole and another fuel passage communicated with said fuel passage;

a driver board assembly which is housed in said inner space of said discharge port member and electrically connected to said connection terminal; and a second mold resin which is filled in said inner space of said discharge port member to isolate, from the fuel flowing through said fuel passage, said driver board assembly and another connecting portion where said driver board assembly is connected to said connection terminal.

2. A pump according to claim 1, wherein said stator is molded with said first mold resin while being attached to said stator support of said stator holder.

3. A pump according to claim 1, further comprising an annular gap formed between an outer circumferential surface of said stator support of said stator holder and an inner circumferential surface of said first mold resin, wherein part of said second mold resin is charged in said gap through said terminal insertion hole of said stator holder to connect said stator support and said first mold resin integrally.

4. A pump according to claim 1, wherein said first mold resin comprises a cylindrical portion which holds said stator and a flange which is integrally provided to said cylindrical portion, and said flange is in tight contact with said first partition of said stator holder through a seal member.

5. A pump according to claim 1, wherein said second partition is formed in a generally planar plate shape in parallel with a rotor shaft of said motor.

6. A pump according to claim 5, wherein said discharge port member is cylindrical in shape; and said inner space of said discharge port member and said fuel passage each have a semicircular sectional shape.

* * * * *